US005647290A

United States Patent [19]

Kastrup et al.

[11] Patent Number: 5,647,290

[45] Date of Patent: Jul. 15, 1997

[54] THREAD-CUTTING MECHANISM FOR EYELET-BUTTON HOLE SEWING MACHINE

[75] Inventors: Eberhard Kastrup; Thomas Nöltge, both of Bielefeld, Germany; Giorgio Meacci, Arezzo, Italy

[73] Assignee: Dürkopp Adler AG, Bielefeld, Germany

[21] Appl. No.: 542,050

[22] Filed: Oct. 12, 1995

[30] Foreign Application Priority Data

Oct. 13, 1994 [DE] Germany ..... 44 36 613.2
Aug. 29, 1995 [DE] Germany ..... 195 31 727.0

[51] Int. Cl.[6] ..... D05B 65/00

[52] U.S. Cl. ..... 112/66; 112/292; 83/905

[58] Field of Search ..... 112/292, 446, 112/296, 298, 68, 66, 69, 475.25; 83/905, 910

[56] References Cited

U.S. PATENT DOCUMENTS

| | | | |
|---|---|---|---|
| 952,010 | 3/1910 | Kiewicz | 112/292 |
| 1,152,464 | 9/1915 | Zaleski | 112/292 |
| 1,640,283 | 8/1927 | Miller | 112/475.25 X |
| 1,865,140 | 6/1932 | Reece | 112/298 X |
| 3,648,634 | 3/1972 | Van Hazendonk | 112/292 |

*Primary Examiner*—Ismael Izaguirre
*Attorney, Agent, or Firm*—Max Fogiel

[57] ABSTRACT

A thread-cutting mechanism for a sewing machine (2), especially an eyelet-buttonhole sewing machine with a moving blade (12 or 12") and a stationary blade (16). The moving blade travels back and forth in a groove (19) in a plate (1) with an aperture for the needle to pass through while it is producing a stitch. The needle-aperture plate comprises at least a top (11 or 11") and a bottom (10 or 10"). The moving blade is entirely accommodated between the top and the bottom of the plate. The stationary blade is part of the top.

18 Claims, 7 Drawing Sheets

THREAD-CUTTING MECHANISM FOR EYELET-BUTTON HOLE SEWING MACHINE

BACKGROUND OF THE INVENTION

The present invention concerns a thread-cutting mechanism for a sewing machine, especially an eyelet-buttonhole sewing machine with a moving blade and a stationary blade. The moving blade travels back and forth in a groove in a plate with an aperture for the needle to pass through while it is producing a stitch.

German B 1 104 805 discloses a thread-cutting mechanism of this genus in a double saddle-stitch sewing machine. A blade is positioned above a slot below the groove in such a plate and secured to a web thereon. The edge of the blade extends into the path traveled by a cutting edge on the bottom of a slide that travels back and forth in the groove. An extension on the side of the blade is bent down and rests on a web that is part of the plate. The slide itself is attached to an actuating slide. To cut the threads, the actuating slide is extracted manually, whereupon the cutting edge on the bottom of the first slide intercepts the threads and draws them tight over the upper blade, severing them. Springs attached to the actuating slide return it to its original position when released. The underthread and the needle-thread loop are severed while the two last stitching points on the material being sewn are equidistant from the needle aperture. The tails that remain with the material are accordingly approximately equal in length, which depends on the particular stitch length.

U.S. Pat. No. 2,752,871 discloses a thread-cutting mechanism on an eyelet-buttonhole sewing machine with a moving blade accommodated below the needle-aperture plate but with no stationary blade. The moving blade is bent into an L and secured to an aligning bracket. The aligning bracket itself is accommodated in a holder. The blade's alignment point is accordingly far from its cutting point. Blades of this type cannot be made of already tempered sheet steel. Such bent blades again cannot be ground to ensure dimensional stability. These thread-cutting mechanisms are accordingly not entirely reliable. Since the mechanism operates without a stationary blade to sever the underthread, it is difficult to cut thicker threads, threads with a count higher than approximately 50/3 for example. Since the needle-aperture plate and the thread-cutting mechanism are screwed tight independently, the rest of the underthread dictates the precise adjustment of the needle aperture in relation to the cutting mechanism.

The thread tails are left free subsequent to its being severed in the aforesaid thread-cutting mechanisms. The uncontrolled situation is detrimental to reliable re-initiation of the seaming procedure (stitch forming).

The buttonhole is opened at one point and sewn at another in the eyelet-buttonhole sewing machine distributed under the designation Dürkopp Adler Kl. 558 by the present applicant. Once the buttonhole has been sewn, the material is advanced to a blade mounted stationary on the machine for cutting. Subsequent to cutting, the looper base is returned to its initial position, whereby the motion that actuates the looper-thread blade rotation derives from the rotation of the looper base. Since the blade is stationary, the buttonhole can be opened only at a specific point. The eyelet is accordingly always the same distance from the sewing point (needle) no matter how long the buttonhole is, whereas the position of the corner of the buttonhole varies with that length. The trimmed looper-thread tails remaining in the material accordingly depend on the length of the buttonhole. The end of a short buttonhole will be farther from the sewing point than the end of a long buttonhole. The length of the trimmed tails will consequently vary inversely with the length of the buttonhole. The needle thread is severed from the looper thread with no additional blade.

SUMMARY OF THE INVENTION

With the foregoing as a point of departure, the object of the present invention is an improved thread-cutting mechanism that can be employed in particular in a sewing machine with rotating sewing components at heightened cutting capacity and reliability and at longer life and whereby the residual thread length is independent of the particular buttonhole length.

This object is attained in the generic thread-cutting mechanism in accordance with the present invention in that the needle-aperture plate comprises at least a top and a bottom, the moving blade is entirely accommodated between the top and the bottom of the plate, and the stationary blade is part of the top.

The at least two-part structure of the needle-aperture plate allows the moving blade to be enclosed on all sides. The distance between the thread-severing point and the knife bearing can accordingly be short, making the cutting procedure more reliable and increasing the life of the blade.

When the moving blade severs the thread it can travel in a direction opposite the direction the material advances in.

In a generic thread-cutting mechanism the looper-adjacent thread tail can be diverted by an aperture in the needle-aperture plate and opposite the direction the material is being advanced in prior to being cut in order to sever at least one looper thread subsequent to sewing. In either case the severed looper-thread tail will extend toward the new eyelet buttonhole. It is important to emphasize that the seams are always produced opposite the material-advance direction. The trimmed and in any case already short looper-thread tail is accordingly sewn into the beginning of the buttonhole surround and disappears entirely. The already short-trimmed tail ensures that the sew-in thread will not stick out.

It is of advantage for the diverted tail to be capable of being fastened prior to being trimmed. This approach not only prescribes the residual length of the tail but also reliably positions it inside the new buttonhole surround.

The stationary blade in one particularly advantageous and simple embodiment can be integrated into the lower end of a rectangular, particularly in cross-section, groove. The needle-aperture plate can be machined with a laser beam to ensure that its edge will be as long as possible and that the looper thread will be reliably severed.

Accommodating the moving blade on all sides ensures accurate cutting, and even thicker threads can be severed.

Since the top and bottom of the needle-aperture plate are screwed together, the thread-cutting mechanism is integrated into the plate and constitutes a single assembly with it.

It is general knowledge that the needle-aperture plate in an eyelet-buttonhole sewing machine must be rotated in order to produce the buttonhole surround. Since the thread-cutting mechanism is integrated into the needle-aperture plate, it will rotate along with it. This makes it possible to immediately trim off the looper thread once sewing has been discontinued and before the material is advanced to the buttonhole-opening point. How far the trimmed-off tails extend into the material accordingly depends on the prescribe buttonhole length.

Ideal adjustment is possible when the top and bottom of the needle-aperture plate move in relation to each other.

The moving blade can be resiliently forced against the top of the plate, adjusting the thread-cutting mechanism, positioning the top of the plate in relation to the bottom, that is, establishes tension that forces the stationary blade against the moving blade. The mechanism will accordingly sharpen itself automatically while operating and will accordingly last longer.

A fastening web on the bottom of the plate is of advantage. The web can have an interior thread. A holder that is part of the looper base and is intended to accommodate the web can have a recess in the form of a slot that opens upward, allowing the web and the holder to be forced together by a screw.

This approach allows the assembly comprising the needle-aperture plate and the thread-cutting mechanism to be assembled prior to very simple integration into the sewing machine. It will accordingly be completely unnecessary to readjust the machinery. Fastening the components together with just one screw makes it possible to remove and replace the assembly, to clean it or exchange it for example.

A thread grip below the moving blade is also advantageous. Such a grip will constitute a curved sheet of spring steel and a screw. The moving blade can force the thread into the grip before severing it. The looper-end tail is accordingly clamped in a prescribed position. The force of the sheet must be powerful enough to grasp the underthread and ensure that the needle thread will be able to intercept the underthread loop after the first or second stitch in the subsequent seam production and drag it up out of the grip and through the needle aperture.

The thread grip can be designed to ensure that the moving blade is tensioned against the stationary blade during the cutting procedure once the looper thread has been drawn into it.

BRIEF DESCRIPTION OF THE DRAWINGS

Various embodiments of the present invention will now be specified with reference to the accompanying drawing, wherein.

DESCRIPTION OF THE PREFERRED EMBODIMENTS

Figure 1:
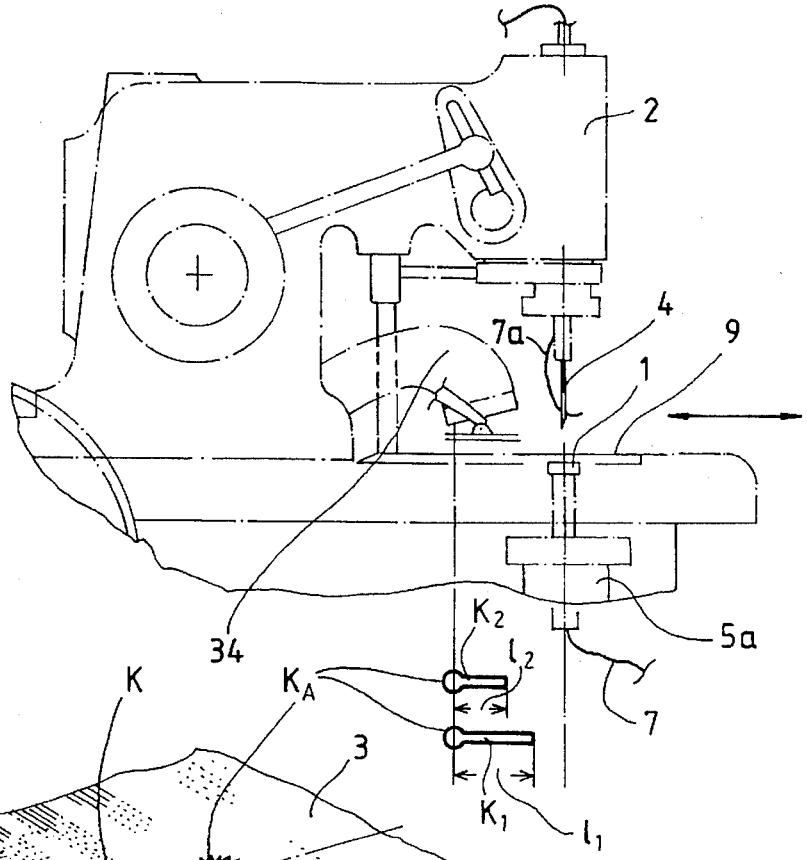
FIG. 1 is a schematic side view of an eyelet-buttonhole sewing machine.

FIG. 1 illustrates an eyelet-buttonhole (chain stitching or double chain stitching) sewing machine 2 with a needle 4 that travels up and down inside it as generally known. A material-supporting surface 9 has a cutout that accommodates a plate 1 with a needle aperture 1'. Needle-aperture plate 1 in turn accommodates the mechanism for cutting the needle thread and the mechanism for cutting the looper thread that will be the exclusive subject of what follows. The mechanism for cutting the needle thread is state-of-the-art. A looper 5 is accommodated also as generally known below material-supporting surface 9 in the lower part of sewing machine 2. In order to produce an eyelet buttonhole K the sewing components (looper 5 and needle-aperture plate 1) must as is generally known be rotated for the specific purpose of sewing the circular eyelet $K_A$. Fastened to sewing machine 2 is a mechanism 34 that opens the buttonhole once the surround has been stitched out. The material must already have been advanced for this procedure until the surround is underneath buttonhole-opening mechanism 34. The lengths $l_1$ and $l_2$ of buttonholes K1 and K2 can vary as desired. Buttonhole-opening mechanism 34 is designed as generally known in accordance with the desired length. As will be evident from FIG. 1, eyelet $K_A$.

Figure 2:
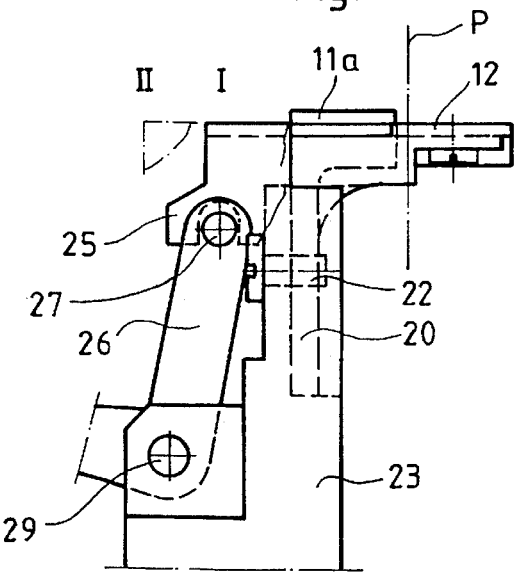
FIG. 2 is a front view of a thread-cutting mechanism with parts of its drive mechanism.

Needle-aperture plate 1 consists of a bottom 10 and a top 11. A moving blade 12 travels back and forth horizontally between bottom 10 and top 11. As will be evident from FIG. 2, moving blade 12 travels back and forth on a block 25. There is a slot 28 in the bottom of block 25. A lever 26 is secured in slot 28 by a pin 27. Lever 26 is articulated by a shaft 29 to the base 5*a* of looper 5. Lever 26 is also coupled to a transmission that pivots it back and forth around shaft 29. As lever 26 rocks back and forth it displaces moving blade 12 horizontally back and forth between a position I and a position II. Position I is the position of moving blade 12 after it has severed the thread and while the buttonhole is being sewn, the producing position in other words.

Moving blade 12 is fastened at the rear to block 25 by a screw 35. The bottom 10 of needle-aperture plate 1 has a groove 19 more or less in the middle. Groove 19 is as wide as the rear of moving blade 12, which is accordingly secured in the groove at three sides. As will be evident from FIG. 7, groove 19 occupies only the rear of bottom 10, which has a cutout 18 at the front. Cutout 18 extends all the way forward. The circumference of bottom 10 is accordingly not completely continuous. At one side of cutout 18 and in alignment with groove 19 is a surface 19*a* that guides the forward end 14 of moving blade 12 as will be specified hereinafter.

A perpendicular web 20 on the bottom 10 of needle-aperture plate 1 fastens the plate in a holder 23. Plate holder 23 is part of looper base 5*a*. Web 20 is provided for this purpose with a threaded bore 21. On the side of bottom 10 that faces moving-blade forward-end guiding surface 19*a* is an area 10*a* elevated above the rest of the surface. As will be evident from FIG. 5, elevated area 10*a* engages a matching depression 11*b* in the top 11 of needle-aperture plate 1. There is a gap of approximately 0.5 mm between depression 11*b* and elevated area 10*a*. There is accordingly enough play between the components to ensure relative motion between top 11 and bottom 10.

The top 11 of needle-aperture plate 1 is fastened to its bottom 10 by diagonally opposed screws 31*a* and 31*b*. The parts are not, however, screwed together tight, but have between them a slight play b of approximately 0.4 to 0.5 mm. The top 11 of the plate can accordingly, and due to the aforementioned gap, rock back and forth on bottom 10 around an axis extending through the centers of screws 31*a* and 31*b*. There is an essentially L-shaped cutout 17 at the center of top 11 that to some extent matches the cutout 18 in bottom 10 and constitutes in conjunction with it a needle aperture 1'.

Figure 3:
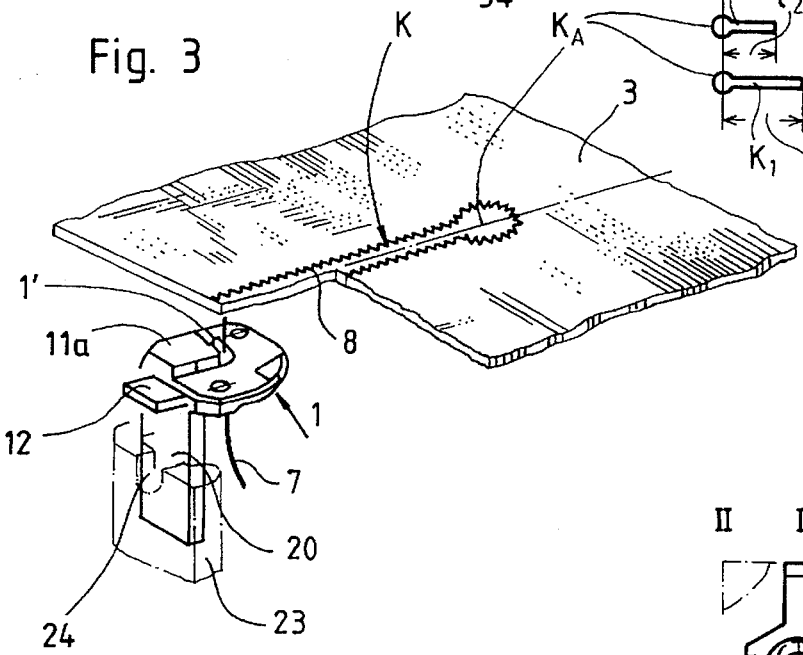
FIG. 3 is a perspective view of a combination needle-aperture plate and thread-cutting mechanism with a piece of sewing material resting on it.
Figure 5:
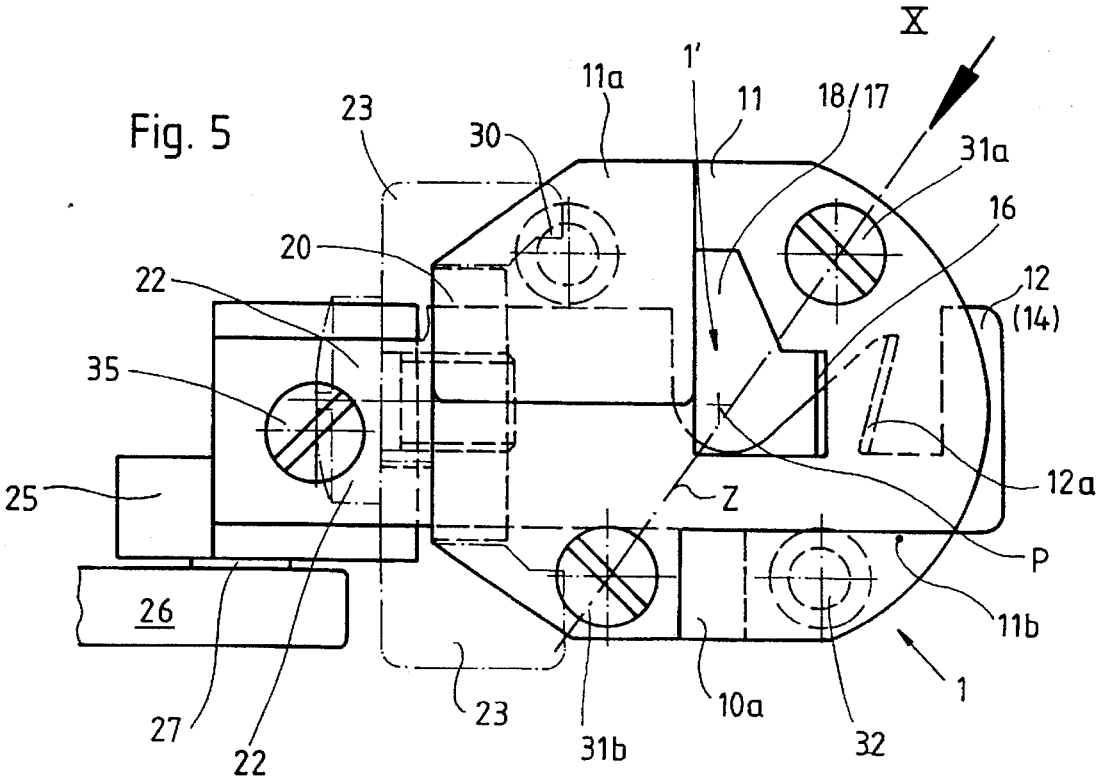
FIG. 5 is a view in the direction indicated by arrow V in FIG. 4.

FIG. 5 illustrates a needle-penetration point P within cutouts 17 and 18. The top 11 of needle-aperture plate 1 has an area 11*a* at the rear that is thicker than the rest of the component. As will be evident from FIG. 3, thicker area 11*a* extends half-way along top 11 in two directions. Depression 11*b* is diametrically opposite on the front of top 1. Since depression 11*b* is as deep as elevated area 10*a* is high, the surface of needle-aperture plate 1 will be uniform with the exception of thicker area 11*a* once top 11 and bottom 10 have been screwed together.

Figure 9:
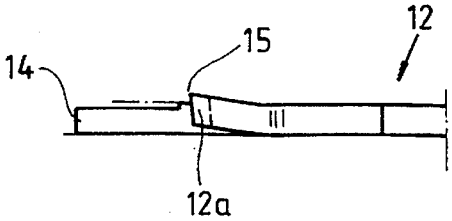
FIG. 9 is a side view of the moving blade in the direction indicated by arrow IX in FIG. 8.
Figure 4:
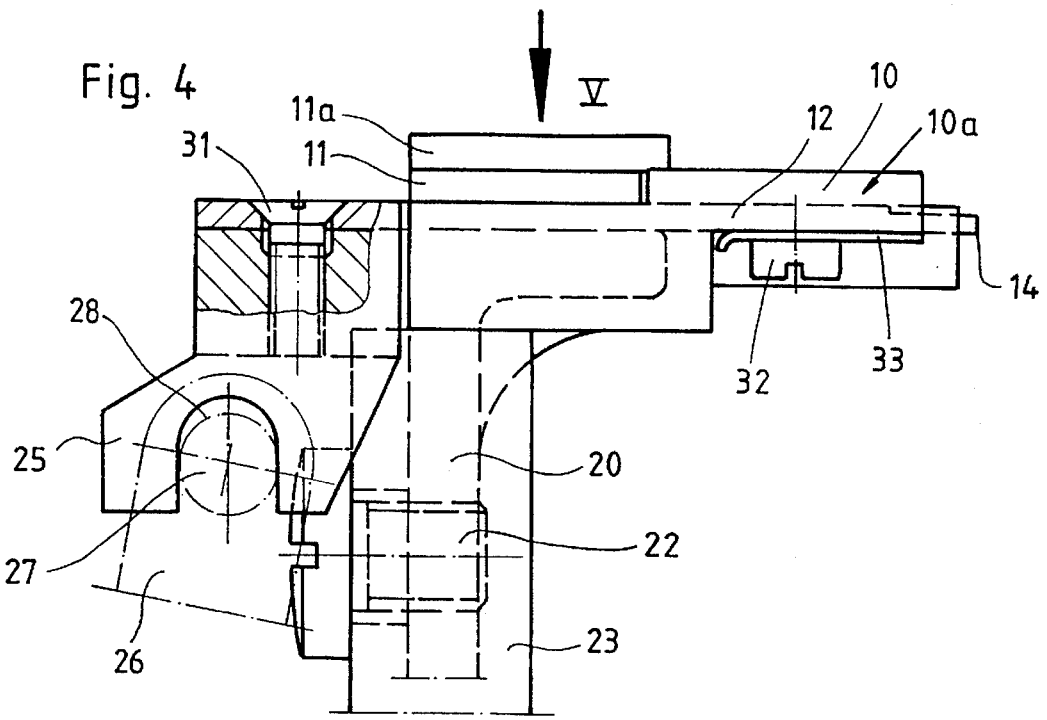
FIG. 4 is an enlarged illustration of part of FIG. 2.
Figure 6:
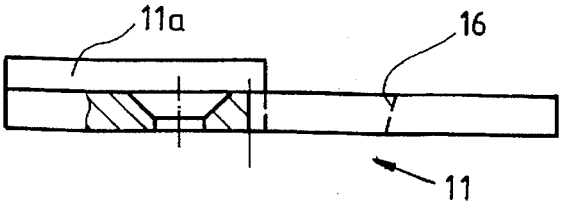
FIG. 6 is a side view of the top of the plate.
Figure 7:
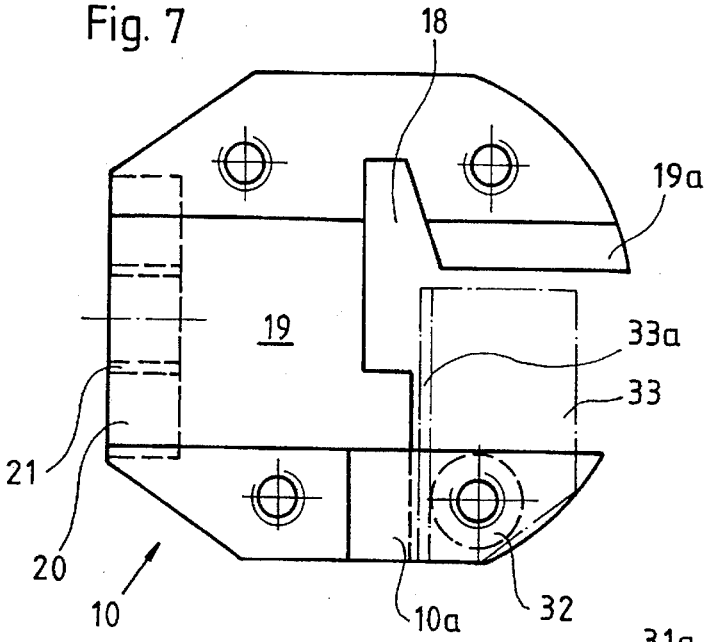
FIG. 7 is a top view of the bottom of the plate.
Figure 8:
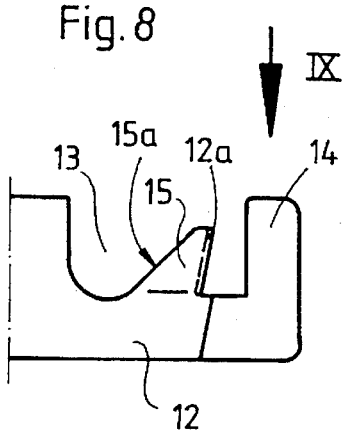
FIG. 8 is a top view of part of the moving blade.
Figure 10:
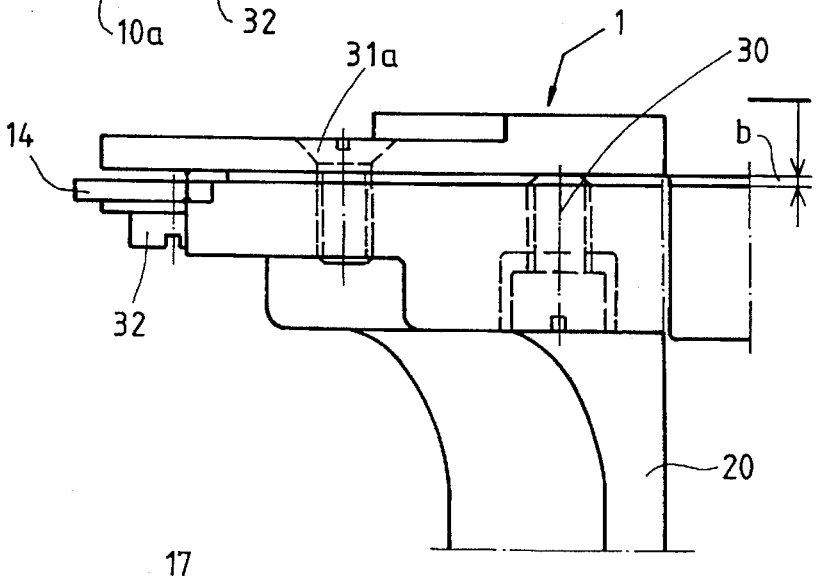
FIG. 10 is view in the direction indicated by arrow X in FIG. 5.
Figure 11:
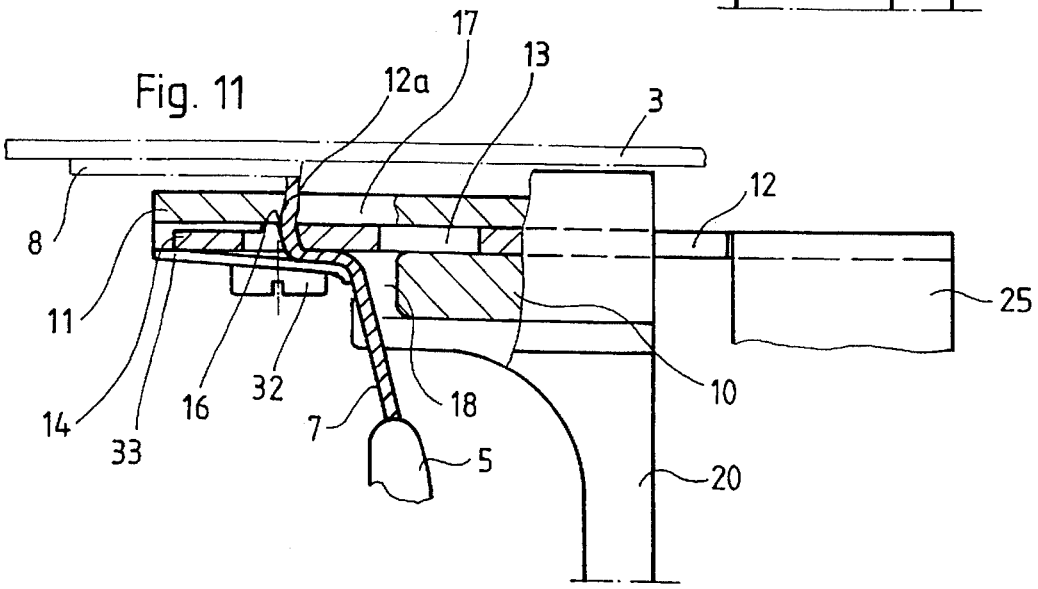
FIG. 11 is a partial section through a thread-cutting mechanism in accordance with the present invention.
Figure 12:
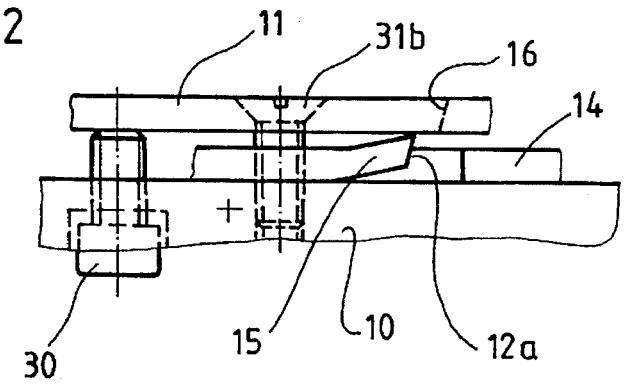
FIG. 12 illustrates part of the thread-cutting mechanism in accordance with the present invention.
Figure 13:
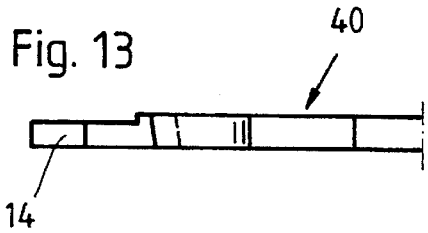
FIG. 13 illustrates an embodiment of the moving blade similar to that in FIG. 9.

FIGS. 6 and 11 illustrate how stationary blade 16 is integrated into the top 11 of needle-aperture plate 1. While moving blade 12 is in position I, its forward end 14 is above the plate. As will be evident from FIG. 9, the forward end 14 of the blade is thinner than its rear end. As will be evident from FIG. 8, there is a cutting edge 12*a* on the front of a bent-up extension 15 in back of thinner forward end 14. The material between forward end 14 and extension 15 has been removed. Cutting edge 12*a* slopes back slightly. Behind extension 15 is a semicircular cutout 13. Semicircular cutout 13 coincides with the L-shaped cutout 17 in the top 11 and with the cutout 18 in the bottom 10 of needle-aperture plate 1 as long as moving blade 12 is in position I, and aperture 1' will accordingly be unobstructed, allowing needle 4 to penetrate freely. Although FIGS. 7 and 8 are not in the same scale, it will be evident that the thinner forward end 14 of moving blade 12 slides along surface 19*a* while its rear is secured on all sides in groove 19. The bent-up extension 15 on moving blade 12 will rest against the lower surface of top 11 while the top and bottom of needle-aperture plate 1 are being fastened together. Moving blade 12 will accordingly be tensioned relative to top 11, and cutting edge 12*a* can be positioned at an angle to the cutting edge of the stationary blade 16 on top 11. The threads will accordingly be severed not by hacking but by shearing. In this operation, cutting edge 12*a* will scissor against the cutting edge of stationary blade 16, and the two edges will automatically whet each other thereby. The thinner forward end 14 of moving blade 12 will accommodate the bending moment that accompanies the tensioning of moving blade 12.

A screw 30 is screwed through the bottom 10 of needle-aperture plate 1 and applies pressure against the lower surface of top 11. The play b between top 11 and bottom 10 can be varied with pressure-application screw 30. The tilt of top 11 around the axis Z through screws 31*a* and 31*b* can accordingly be restricted. Screws 31*a* and 31*b* must be screwed far enough in while top 11 and bottom 10 are being fastened together for the bent-up extension 15 to apply tension to moving blade 12. A screw-securing compound (e.g. Loctite) can be applied to prevent loss of adjustment due to unintended loosening of screws 31*a* and 31*b*. A thread grip in the form of a strip 33 of spring steel is fastened to the lower surface of bottom 10*a* by a screw 32. One longitudinal edge 33*a* of spring-steel strip 33 is bent down. As will be evident from FIG. 11, looper thread 7 is forced down below the bent-down edge 33*a* of spring-steel strip 33 by the cutting edge 12*a* of moving blade 12 as the blade moves forward out of position II and into position I. Spring-steel strip 33 can be 0.3 mm thick and will be resilient enough to reliably fasten looper thread 7 between it and the lower surface of the bottom 10 of needle-aperture plate 1 while simultaneously ensuring that, as sewing commences again, needle thread 7*a* will be able to intercept the loop and draw it up through needle aperture 1'. It will also be evident from this figure that the semicircular cutout 13 in moving blade 12 will coincide with the L-shaped cutout 17 in the top 11 and with the cutout 18 in the bottom 10 of needle-aperture plate 1 while the blade is in position I. The thread-cutting mechanism hereintofore specified is employed only to sever looper threads 7, and needle threads 7*a* must be handled by another, unillustrated, mechanism. In order to sever looper thread 7 again, moving blade 12 must be returned to position II with sewing machine 2 stopped and needle 4 extracted from material 3. Looper thread 7 will now extend out of semicircular cutout 13, along the forward-sloping edge 15*a* of bent-up extension 15, in front of cutting edge 12*a*, and into the cutout between bent-up extension 15 and the thinner forward end 14 of moving blade 12.

The already established assembly of needle-aperture plate 1 and thread-cutting mechanism is now fastened to the holder 23 integrated into the unillustrated looper base by a screw 22 that screws into web 20. As will be evident from FIG. 3, plate holder 23 has for this purpose an upward-opening slot 24. Material 3 will rest against either thicker area 11*a* or the rest of material-supporting surface 9 while buttonhole surround 8 is being produced.

Once the thread-cutting mechanism is in operation, the looper thread 7 that needs to be severed will be intercepted by the bent-up extension 15 on moving blade 12 and, as the blade moves out of position II and into position I, will be drawn down below spring-steel strip 33 as represented in FIG. 11.

This procedure is accompanied by resilient flection on the part of spring-steel strip 33 forcing moving blade 12 more powerfully against stationary blade 16. The limitation of the motion of the top 11 of needle-aperture plate 1 against pressure-application screw 30, however, allows only the resilient compression of moving blade 12 and stationary blade 16, and the thread will be very dependably severed.

The resilient flection of spring-steel strip 33 can even by itself ensure that moving blade 12 will be forced against stationary blade 16. The moving blade 40 in another embodiment of the thread-cutting mechanism in accordance with the present invention is flat, meaning that extension 15 is not bent up it is on the moving blade 12 in the first embodiment. FIGS. 13 through 16 illustrate moving blade 40 along with its associated plate top 11'.

Figure 15:
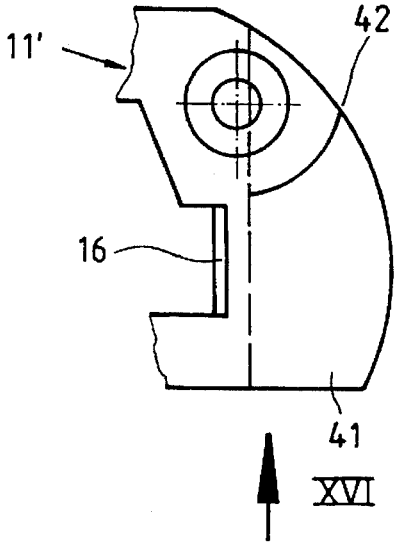
FIG. 15 is a top view of the top of the plate in the second embodiment of the present invention.
Figure 16:
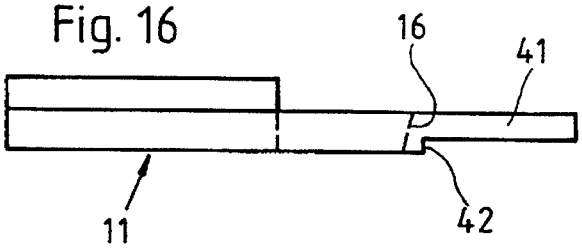
FIG. 16 is a view of the top of the plate in the direction indicated by arrow XVI in FIG. 15.

As will be evident from FIGS. 15 and 16, the top 11' of the needle-aperture plate is cut open, leaving a thin end 41. Thin end 41 is demarcated by an edge 42.

Figure 14:
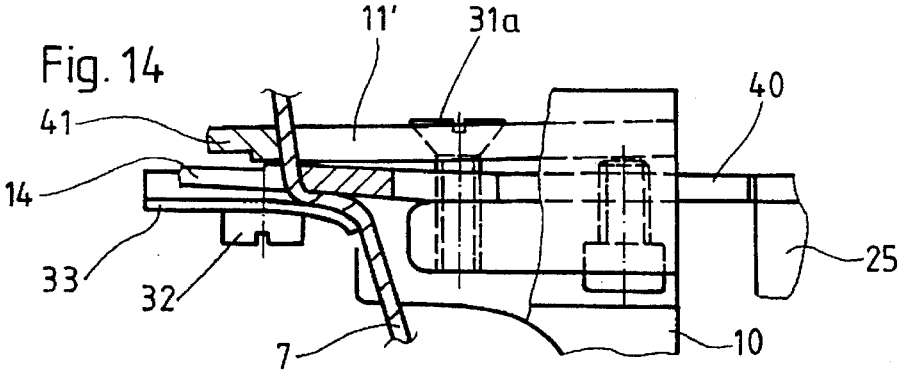
FIG. 14 is a partly sectional illustration of another embodiment of the thread-cutting mechanism in accordance with the present invention similar to that illustrated in FIG. 11.
Figure 17:
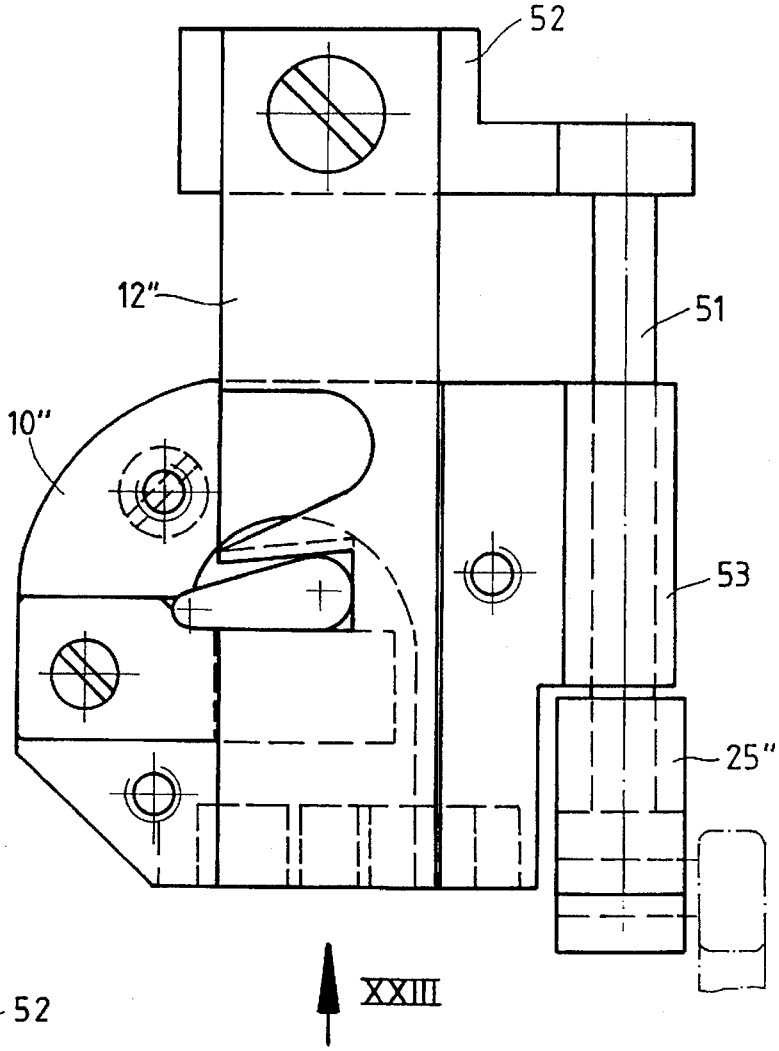
FIG. 17 is a top view of another embodiment of a thread-cutting mechanism with the top of the plate removed.
Figure 22:
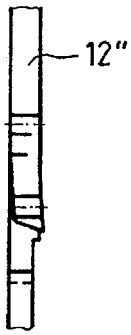
FIG. 22 is a side view of part of one of the assemblies illustrated in FIG. 21 in the direction indicated by arrow XXII.
Figure 21:
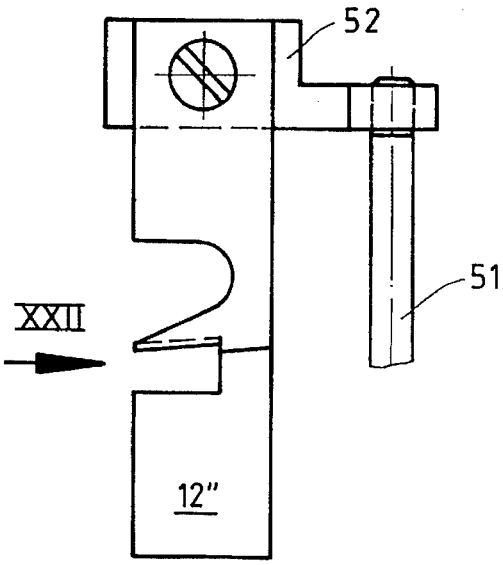
FIG. 21 is a smaller-scale view of one of the assemblies illustrated in FIGS. 17 and 18.
Figure 23:
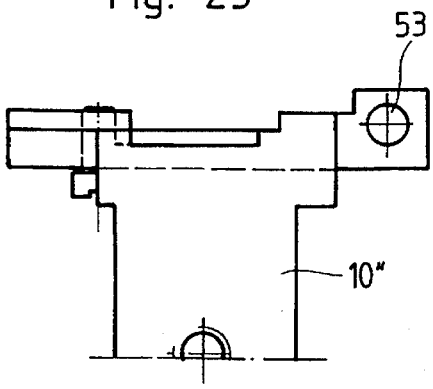
FIG. 23 is a smaller-scale view in the direction indicated by arrow XXIII in FIG. 17.
Figure 18:
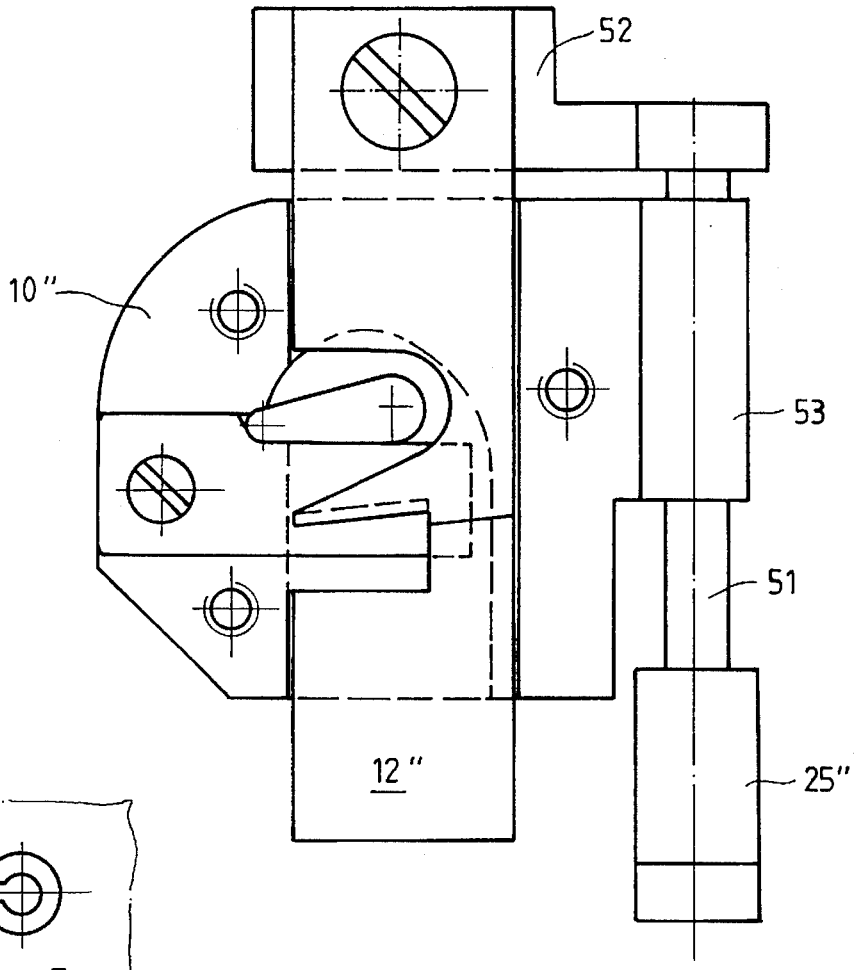
FIG. 18 is a view similar to that in FIG. 17 with the moving blade at the other end of its stroke.

FIG. 14 is a view similar to that in FIG. 11 and illustrates the deformation of moving blade 40 that results from the aforesaid resilient flection of spring-steel strip 33 by looper thread 7. As will also be evident from this figure, the thin end 41 of needle-aperture plate top 11' ensures in conjunction with thinner forward end 14 that moving blade 40 and stationary blade 16 can come into contact only at their edges. It can be practical in this embodiment for spring-steel strip 33 to be of a slightly thicker material. One particular advantage of the present embodiment is that moving blade 40 is easier to manufacture than moving blade 12.

Another embodiment of the present invention is illustrated in FIGS. 17 through 26. Parts that are similar in structure or function to those in the first embodiment will be labeled with the same numbers but followed by a double prime to indicate that they are part of the second embodiment.

In contrast to the first embodiment, moving blade 12" travels as it cuts against the direction T traveled by material 3. Moving blade 12" is coupled by way of a horizontal arm 52 to a shaft 51. Shaft 51 is accommodated in a bearing 53. Bearing 53 is fastened to the bottom 10" of needle-aperture plate. A block 25" is forced against the free end of shaft 51 once the shaft has entered bearing 53. Block 25" is controlled by a lever 26". Stationary blade 16 is part of the lower edge of a cutout 50 in the top 11" of the needle-aperture plate. As will be evident from FIGS. 19 and 24, cutout 50 is rectangular and is preferably laser-machined into top 11".

Figure 26:
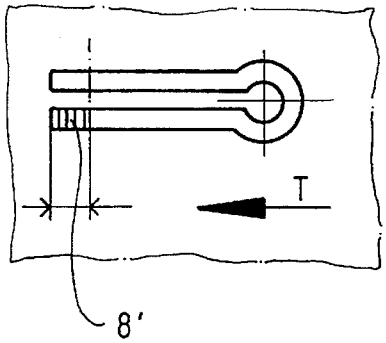
FIG. 26 is a view of the sewing material in the direction indicated by arrow XXVI in FIG. 25.
Figure 25:
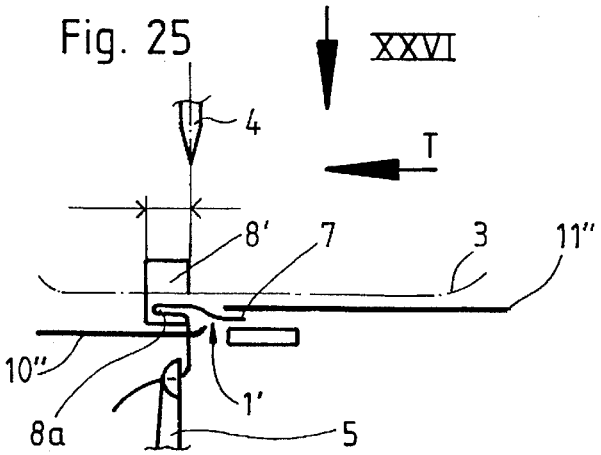
FIG. 25 is a schematic illustration of the stitch-production area in accordance with the view in FIG. 20.
Figure 24:
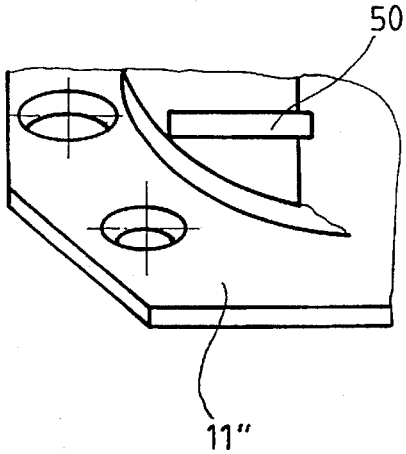
FIG. 24 is a view in the direction indicated by arrow XXIV in FIG. 20.
Figure 20:
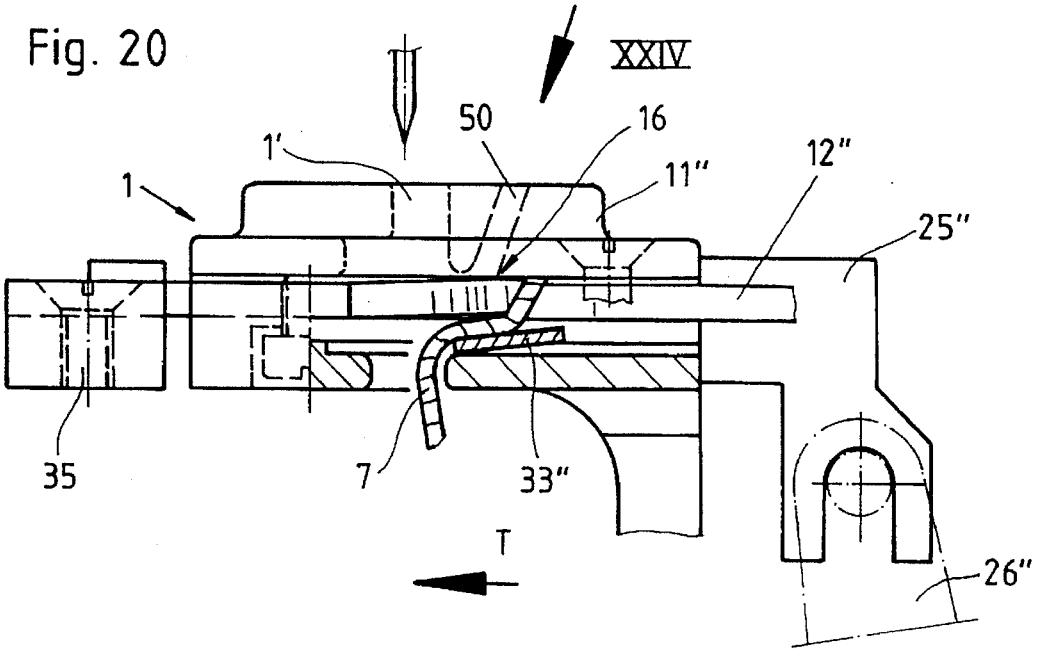
FIG. 20 is a partly sectional view of the thread-cutting mechanism along the line XX—XX in FIG. 19.
Figure 19:
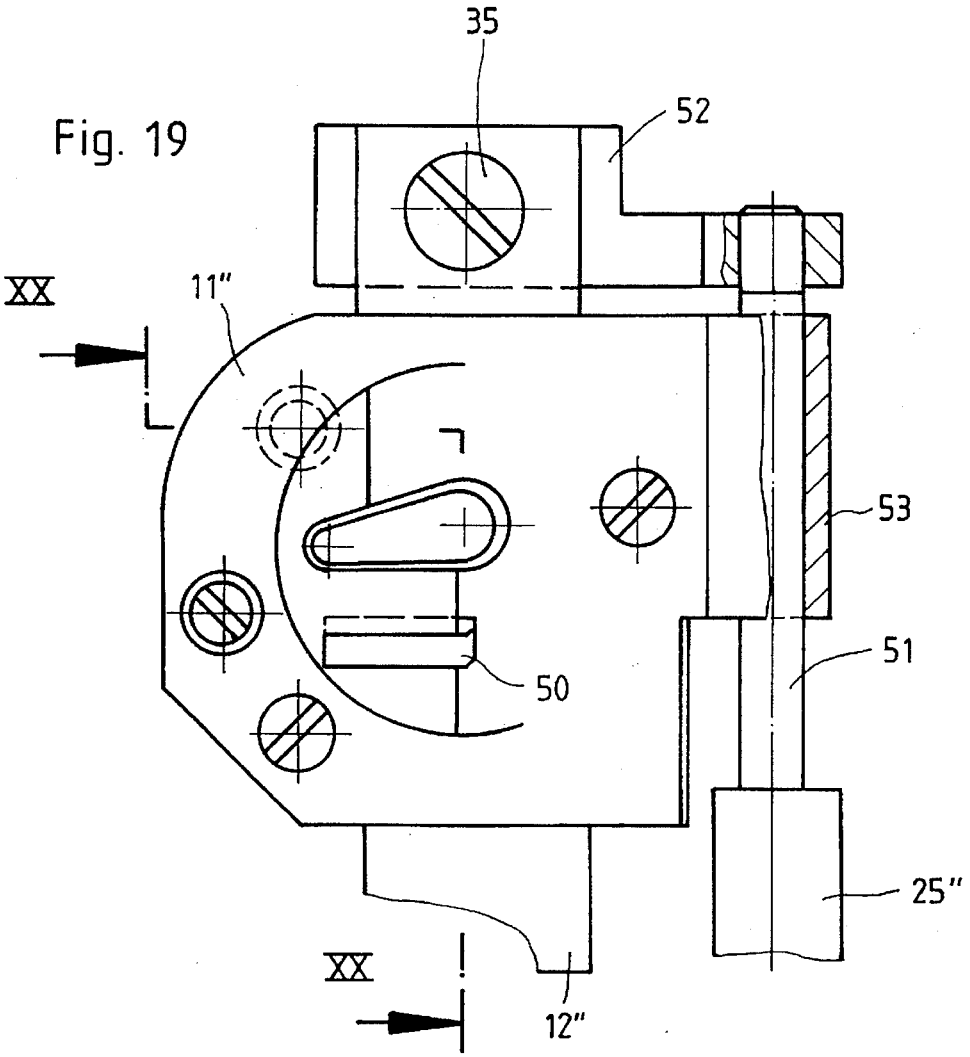
FIG. 19 is a top view of a thread-cutting mechanism with a plate top.

As will be evident from FIG. 20, the severed looper thread 7 is clamped tight by blades 12" and 16" over spring-steel strip 33" against material-advance direction T. The clamping action occurs between spring-steel strip 33" and moving blade 12". When it is time to produce the next buttonhole surround 8, the clamped tail of looper thread 7 is extracted from the clamp and sewn into the initial section 8' of the surround as illustrated in FIG. 26. The tail of looper thread 7 is sewn into the end **8*a* of surround 8 on the right in FIG. 25. End 8*a*** is the upper end. The at any rate already short-trimmed tail will accordingly be invisible in the finished eyelet buttonhole K.

The bottom 10" and top 11" of the needle-aperture plate are essentially similar to those in the first embodiment. Since any modifications necessitated by the reversed thread-cutting direction or by the design of stationary blade 16 will be evident to one of skill in the art from that skill alone, no specification is necessary.

We claim:

1. A thread-cutting mechanism for an eyelet-buttonhole sewing machine comprising a moving blade and a stationary blade; a plate with an aperture for the needle to pass through while producing a stitch, said plate having a groove, said moving blade traveling back and forth in said groove for cutting a thread; said plate having at least a top and a bottom; said moving blade being entirely located within said plate between said top and said bottom of said plate; said stationary blade being part of said top; the thread being cutable directly at a workpiece for leaving only substantially short ends of the thread at the finished workpiece; said thread being in a specific position for being directly cut when the thread passes through said aperture; a thread clamping member located within said plate for clamping and wiping said thread, said thread being pushed below said clamping member by said moving blade while said thread is being cut, when sewing a new buttonhole, said thread clamped below said clamping member being itself pulled out at the beginning of sewing a subsequent buttonhole; said clamped thread being in a specific position in relation to a sewing direction to achieve a sewing in of a thread end slipping by itself out of said clamping member and achieving thereby an oversewing.

2. A thread-cutting mechanism as defined in claim 1, wherein said moving blade travels in a direction opposite the direction the material advances in when said moving blade cuts the thread.

3. A thread-cutting mechanism as defined in claim 1, wherein a looper-adjacent tail of the thread is diverted by said aperture in said plate and opposite the direction that the material is being advanced in prior to being cut for cutting at least one looper thread subsequent to sewing.

4. A thread-cutting mechanism as defined in claim 3, wherein the diverted tail is fastened prior to being trimmed.

5. A thread-cutting mechanism as defined in claim 1, wherein said stationary blade is integrated into a lower edge of a rectangular cutout 50.

6. A thread-cutting mechanism as defined in claim 1, wherein said top and said bottom of said plate are screwed together.

7. A thread-cutting mechanism as defined in claim 6, wherein said top and said bottom of said plate move in relation to each other.

8. A thread-cutting mechanism as defined in claim 7, wherein said top of said plate tilts back and forth around an axis; screws fastening said plate, said axis extending through centers of said screws.

9. A thread-cutting mechanism as defined in claim 8, including a pressure-application screw, tilting of said top of said plate by said pressure-application screw.

10. Thread-cutting mechanism as defined in claim 9, wherein said pressure-application screw is accommodated in said bottom of said plate.

11. A thread-cutting mechanism as defined in claim 1, wherein said moving blade can be resiliently forced against said top of said plate.

12. A thread-cutting mechanism as defined in claim 11, wherein said moving blade has a resilient extension bent up toward said top of said plate.

13. A thread-cutting mechanism as defined in claim 12, wherein said moving blade has a cutting area that is part of said resilient extension.

14. A thread-cutting mechanism as defined in claim 11, including thread gripping means for exerting said resilience.

15. A thread-cutting mechanism as defined in claim 1, wherein said moving blade has a tapering forward end upstream of its cutting area.

16. A thread-cutting mechanism as defined in claim 1, including a fastening web on said bottom of said plate.

17. A thread-cutting mechanism as defined in claim 16, wherein said web has an interior thread; a holder, a recess in form of a slot opening upward, said web and said holder being forcible together by a screw.

18. A thread-cutting mechanism as defined in claim 1, including thread gripping means below said moving blade.

* * * * *